United States Patent [19]

Handy et al.

[11] 4,388,959

[45] Jun. 21, 1983

[54] SOFT CONTAINER FOR JEWELRY

[75] Inventors: Binns Handy, West Henrietta; David O. Chase, Skaneateles, both of N.Y.

[73] Assignee: Lenox, Incorporated, Lawrenceville, N.J.

[21] Appl. No.: 267,862

[22] Filed: May 28, 1981

[51] Int. Cl.[3] ..... B65B 11/48; B65D 65/04

[52] U.S. Cl. ..... 150/52 R; 150/34; 206/566

[58] Field of Search ..... 150/32, 34, 37, 52 R, 150/52 B, 52 C, 52 D, 53, 7; 206/44 R, 566, 45.17; 229/87 R, 87 A, 92.7, 75, 22

[56] References Cited

U.S. PATENT DOCUMENTS

| | | | |
|---|---|---|---|
| 1,368,963 | 2/1921 | Obici | 229/75 |
| 1,486,629 | 3/1924 | Buchsbaum | 150/34 |
| 2,414,615 | 1/1947 | Slotkin | 150/37 X |
| 2,443,702 | 6/1948 | Bruning | 150/7 |
| 2,565,167 | 8/1951 | Bres | 150/52 R |
| 3,024,824 | 3/1962 | Bass | 150/52 R |
| 3,044,429 | 7/1962 | Levi | 150/52 R |
| 3,301,295 | 1/1967 | Fitch | 150/34 |
| 3,370,702 | 2/1968 | Rosen | 206/566 X |
| 3,525,376 | 8/1970 | Muhlhauser | 150/52 R |

FOREIGN PATENT DOCUMENTS

| | | | |
|---|---|---|---|
| 554871 | 6/1923 | France | 150/32 |
| 2258811 | 8/1975 | France | 206/566 |

*Primary Examiner*—William Price
*Assistant Examiner*—Sue A. Weaver
*Attorney, Agent, or Firm*—Weinstein & Sutton

[57] ABSTRACT

A soft container substantially comprised of a one-piece member having a triangular shape when laid flat. A center portion is sewn or otherwise formed to define three triangular flaps, and to facilitate their proper folding, said intermediate portion serving as the support for a jewelry piece or pieces. Two of said flaps fold along the defined folds to cover said intermediate portion. The remaining flap folds down upon the first-mentioned pair of flaps and is provided at its apex with a joining member which cooperates with a complementary joining member at the end of said intermediate portion remote from the apex of said third flap to provide a releasable locking closure. The container is formed of a soft and preferably luxurious fabric which serves as a protective cover for the jewelry and provides protection against tarnishing.

9 Claims, 16 Drawing Figures

SOFT CONTAINER FOR JEWELRY

BACKGROUND OF THE INVENTION

The present invention relates to containers for jewelry pieces and more particularly to a novel container having no pockets or enclosures and comprised of a single piece which, when folded, provides a unique pouch retained in the closed position by a releasable locking means.

Jewelry is typically sold in rigid boxes or a container comprised of a cover lid hingedly mounted to a base member and capable of being selectively locked into the closed and open positions. These containers, while convenient for home or store use, are inconvenient for carrying purposes and also take up unnecessary room due to their characteristic of rigidity. Although soft pouches provided with a draw string at the open end have been used for containing jewelry pieces, it is inconvenient and in fact impossible, if desired, to conveniently display jewelry on the pouch as it is typically permanently joined or sewn along three sides, rendering the pouch impractical for use for display purposes. This is also true of the rigid container as they have not been designed to be held flat and typically only the rather small supporting surface of the base portion is used for display purposes.

BRIEF DESCRIPTION OF THE INVENTION

The present invention provides a novel soft container incorporating all the above characteristics and yet being of extremely simple design and being quite compact, soft and yieldable to facilitate its use in a coat or suit pocket, pocketbook, or more generally, for travel and carrying purposes. The present invention is characterized by comprising a unitary member, having a generally triangular shape and which is sewn or otherwise machined and assembled so as to define three predetermined folds which may also be characterized as hinges about which the three end portions of said member function as flaps to cover the surface circumscribed by said predetermined folds. Two of said three flaps are placed over the aforesaid circumscribed region. The remaining flap is placed over the first and second flaps and is provided at its apex with a closure element for securement to the point of said circumscribed region furthest removed from said apex to form a neat, compact and yet soft and pliable carrier for jewelry pieces and the like, which may consist of one or more items. The folds are predetermined causing the flaps to cover the same central area of the container each time they are folded over and also exposing one of the closure members to facilitate its interaction with the cooperating closure member.

When the pouch is completely open and is placed upon a supporting surface, the fabric finish, which is quite luxurious, provides an extremely advantageous display surface for displaying jewelry either in a retail establishment or in the privacy of one's home, apartment, hotel room, and the like. Since both major surfaces of the pouch are finished in a similar manner, either major surface may be used to advantage to present or display the jewelry. The closure elements are sufficiently inconspicuous as to have only a negligible effect upon the aesthetics of the carrier.

The folds may be defined by stitching or any other arrangement. The circumscribed area is preferably provided with a stiffening sheet to further assist the prefolded regions in defining the hinging folds.

The package, even when completely closed, provides an attractive appearance and serves to protect the contents from being damaged. The soft pouch will not break if dropped or roughly handled.

OBJECTS OF THE INVENTION AND BRIEF DESCRIPTION OF THE FIGURES

It is therefore one object of the present invention to provide a novel soft carrier for jewelry and the like which is capable of being used for both carrying and display purposes.

Still another object of the present invention is to provide a novel soft carrier for jewelry and the like which contains no pockets and is arranged so as to be unfolded or folded to form a neat, attractive geometric shape when in either the open or the closed position.

Still another object of the present invention is to provide a novel carrier for jewelry formed of a soft, luxurious fabric capable of protecting the jewelry pieces contained therein from being damaged and providing protection against tarnishing.

Yet another object of the present invention is to provide a soft pliable member foldable into a protective soft pouch for jewelry and other valuable items, wherein the folds are predetermined to define closure flaps which always fold along the same fold lines to assure that the cooperating closure elements are always brought into proper alignment for closure.

The above as well as other objects of the present invention will become apparent when reading the accompanying description and the drawing, in which.

Figure 8A:
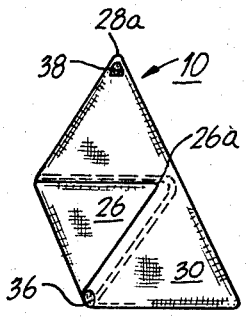
FIG. 8 is a perspective view showing the pouch of FIG. 2 unfolded and showing the interior surface.
Figure 8B:
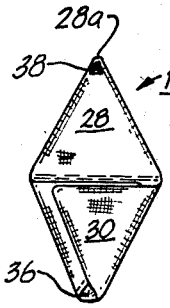

FIGS. 8*a* and 8*b* show developmental plan views helpful in understanding the manner in which the pouch is folded and unfolded.

Figure 7:
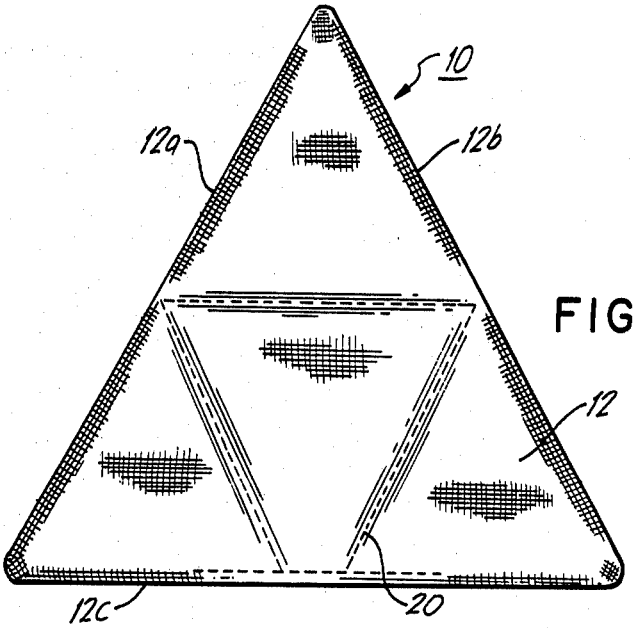
FIG. 7 is a perspective view showing the pouch of FIG. 1 unfolded and showing the exterior surface.
Figure 9:
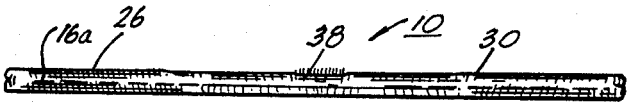
Figure 10:
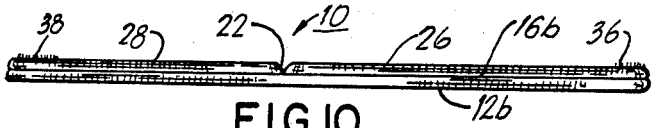
Figure 11:
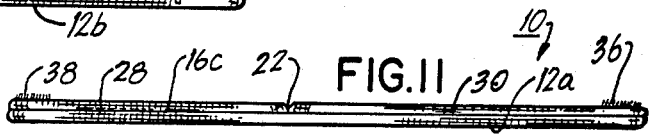

FIGS. 9, 10 and 11 are elevational views respectively showing the three sides of the unfolded pouch of FIG. 7.

Figure 8:
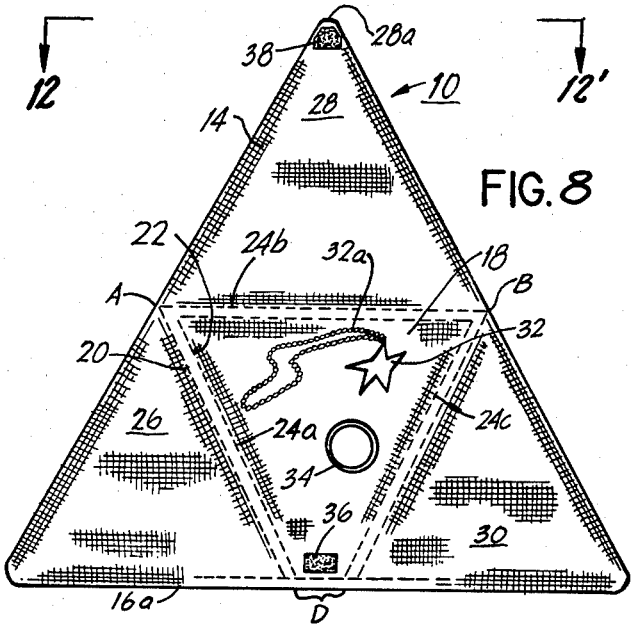
Figure 12:
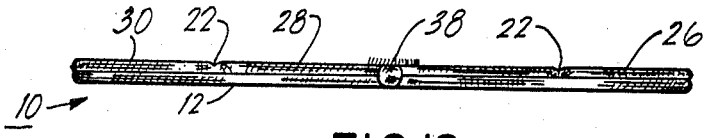

FIG. 12 is an elevational view showing two sides of the pouch looking in the direction of arrows 12—12' of FIG. 8.

Figure 13:
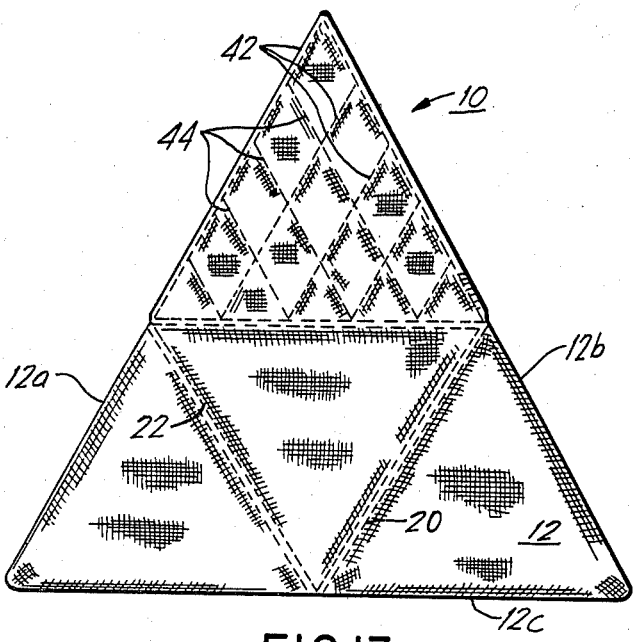

FIG. 13 is a plan view showing a modification of the major surface of the pouch shown in FIG. 7.

Figure 14:
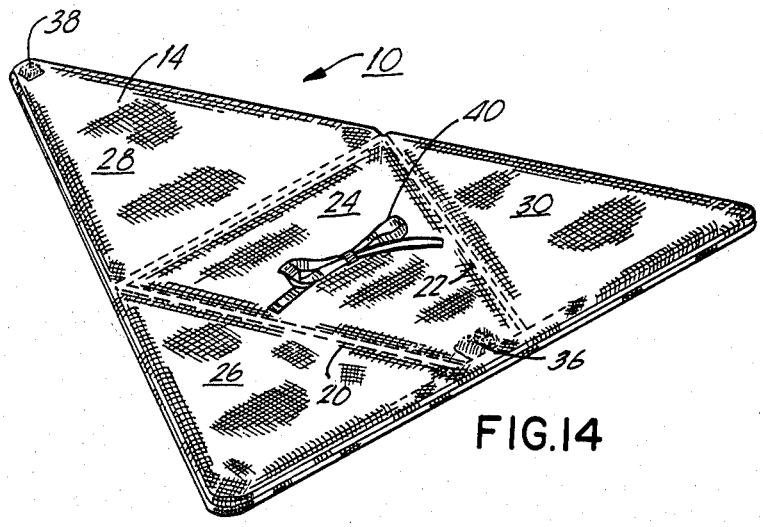

FIG. 14 is a perspective view showing a modification of the major surface of the pouch shown in FIG. 8.

DETAILED DESCRIPTION OF THE INVENTION

FIGS. 7 and 8 show the pouch 10 embodying the principles of the present invention and comprised of a soft, pliable fabric material which is preferably a suitable velvet-like fabric having a soft, luxurious feel and appearance. The pouch 10 is preferably formed of an outer fabric sheet 12 and an inner fabric sheet 14 sewn together to form the hidden seam 16*a*, 16*b*, 16*c* along the three sides of the pouch, shown best in FIGS. 9 through 11.

A suitable filler pad or sheet (not shown), which may, for example, be a triangular-shaped cotton batting 18 or like pad, is positioned between sheets 12 and 14 and is retained in place, preferably by a sewing operation, as represented by the stitching lines 20 and 22. The outer stitching lines 20 are exposed on both surfaces 12 and 14, while the inner stitching lines 22 are hidden relative to sheet 12. The generally triangular-shaped region 24 bounded by stitches 22 provides a slightly raised surface relative to the portions of the pouch 10 surrounding and integral with portion 24, whereby the surrounding portions are softer and more pliable than central portion 24.

As is clear from FIGS. 7 and 8, the pouch 10, in the fully open position, has a triangular shape defining substantially an isosceles triangle wherein, considering FIG. 7, sides 12*a* and 12*b* are equal in length and are both greater in length than side 12*c*.

The lines of stitches 20 and 22 substantially divide the open pouch 10 into four triangular portions including central portion 24 and portions 26, 28 and 30 which form flaps of the pouch. The greater stiffness and somewhat reduced pliability of central portion 24 relative to flaps 26, 28 and 30 greatly facilitate the folding of the flaps 26, 28 and 30 forming the pouch. For example, noting FIG. 8 and 8*a*, flap 26 is moved or folded over to cover marginal portion 24, shown best in FIG. 8*a*. Flap 30, as shown best in FIG. 8*b*, is then folded over so as to cover flap 26.

Figure 1:
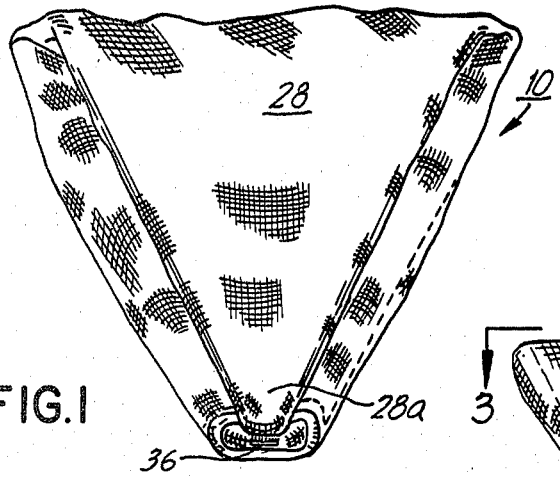
FIG. 1 is a perspective view showing a top and two sides of a closed pouch embodying the principles of the present invention.
Figure 2:
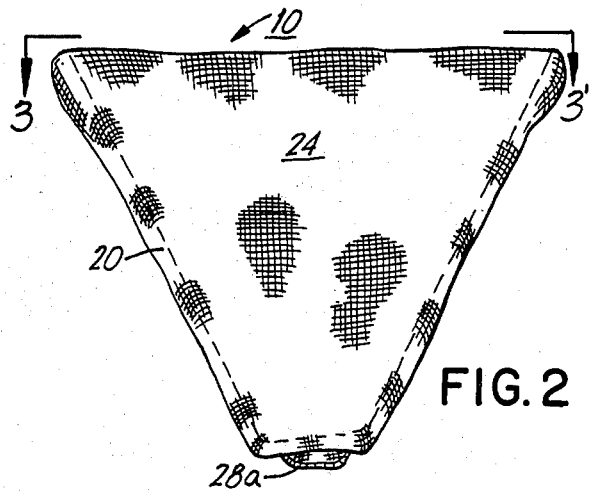
FIG. 2 is a perspective view of the bottom and same two sides of the pouch shown in FIG. 1.

Thereafter, flap 28 is folded over from the position shown in FIG. 8*b* to the position shown in FIG. 1 thereby forming a closed pouch for enclosing, storing and carrying one or more jewelry pieces which preferably are placed upon surface 24, for example, in the manner shown in FIG. 8, wherein the star 32 represents a pendant arranged upon a necklace 32*a*, and wherein a ring 34 is shown as being positioned upon surface 24.

The pouch is retained in the closed position by means of a closure assembly comprised of a small, rectangular pad 36 of loop-type material arranged near the bottom corner of triangular portion 24, shown best in FIG. 8, and a small strip of hook-type material 38 arranged adjacent to tip 28*a* of flap 28. The strips 36 and 38 may be affixed to fabric sheet 14 by a suitable epoxy or may be sewn into place, if desired.

Figure 4:
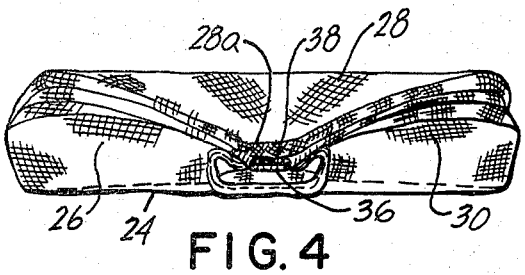
FIG. 4 is an elevational front view of the pouch showing the two sides in view in FIGS. 1 and 2.
Figure 3:
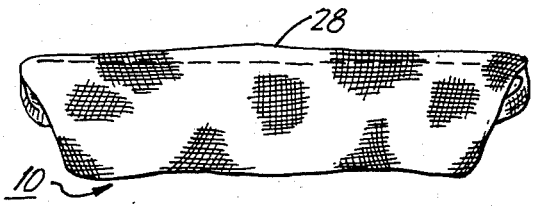
FIG. 3 is an elevational view of the third side not shown in FIGS. 1 and 2 and looking in the direction of arrows 3—3' of FIG. 2.
Figure 5:
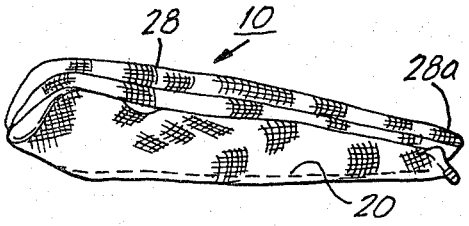
FIG. 5 is an elevational view showing the left side of the pouch shown in FIG. 1.
Figure 6:
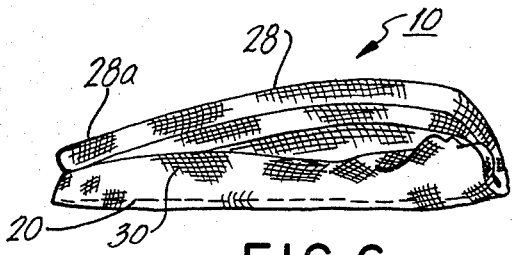
FIG. 6 is an elevational view showing the right side of the pouch shown in FIG. 1

As can best be seen from FIG. 8, the stitches 20 and 22 defining the sides 24*a* and 24*b* and 24*b* and 24*c* of central portion 24, intersect substantially at a point, represented by points A and B. However, the stitches 20 and 22 defining the sides 24*a* and 24*c* are arranged so that their adjacent ends are separated by a gap distance D. The stitches 20, 22 define fold lines which cause the flaps 26 and 30 to be folded over in such a way that the small gap region receiving closure member 36, and hence closure member 36 is uncovered, as shown best in FIG. 8*b*. Thus, when flap 28 is folded down from the position shown in FIG. 8*b* to the position shown in FIGS. 1 and 4, for example, pressing of the closure member 38 into closure member 36 is facilitated. This fold line arrangement thus greatly simplifies the closure of the pouch. Although FIGS. 8*a* and 8*b* show flap 30 as being folded over flap 26, it should be understood that flap 26 may alternatively be folded over flap 30 in order to close the soft pouch. Also, the stitching 20, 22 cause the flaps 26, 28 and 30 to always be folded along the same fold lines. It should further be understood that the pouch 10 is unfolded in the reverse order, starting with FIG. 1, by peeling fastener member 38 apart from member 36, lifting flap 28 to the position shown in FIG. 8*b*, moving flap 30 to the position shown in FIG. 8*a* and finally moving flap 26 to the position shown in FIG. 8.

Although a closure using cooperating hook-type and loop-type pads is preferred, since it will not in any way mar or damage the jewelry pieces and since it is a fabric, it should be understood that other closures may be utilized, if desired. For example, strip 36 may comprise a male portion of a snap closure and strip 38 may comprise a female portion of the snap enclosure which may be releasably inserted into the female part of the snap closure. Obviously, other types of closures may be employed, if desired. For example, closure member 36 may be replaced by a button and closure member 38 may be replaced by a buttonhole.

The jewelry pieces 32, 34 arranged within the pouch 10 are substantially fully enclosed within the pouch 10 which provides a safe and yet handy and elegant way of carrying jewelry pieces. The pouch 10 easily fits into all forms of carrying members such as a jacket pocket, a luggage piece, small, medium and large-size handbags, and the like. The softness of the material protects the jewelry pieces such as 32 and 34 enclosed against the damage or jostle with other hard objects within the pocket or carrying case and further, takes up a minimum of space within a pocket or handbag due to its relatively flat configuration, even when closed, as shown in FIGS. 1 through 6.

The pouch 10, when fully opened, as shown best in FIG. 8, also serves as a means for conveniently and elegantly displaying the jewelry pieces such as 32 and 34 to aid in their selection and in the case of commercial applications to induce and enhance sales.

For example, the jewelry piece or pieces are arranged within a closed pouch 10 which, in one preferred embodiment, is shipped within a triangular box of the size suitable for receiving the pouch in the closed condition, as shown, for example, in FIG. 1. The commercial establishments then display jewelry pieces by opening the pouch 10 which then serves to display the jewelry pieces in an elegant, luxurious manner.

The aesthetic appearance of the soft pouch 10 is further enhanced, for example, in the manner shown in FIG. 14 wherein a fanciful ribbon 40 is affixed to the central portion of interior face 14.

In the pouch 10 shown in FIG. 13, the aesthetic appearance of the exterior surface 12 is further enhanced by the parallel sets of stitches 42 and 44 which intersect with one another to create an appealing quilted effect.

As can be seen from the foregoing, the soft pouch of the present invention is designed to enclose jewelry securely and protect the finish of gold, silver and pewter as well. The form and softness and pliability of the pouch also adapts well to a variety of jewelry sizes and styles. The package can accommodate preferably four types of products, namely, rings, bracelets, earrings and necklaces and pendants. The pouch in the open position provides a simple and yet elegant means for display purposes either for commercial or personal uses.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A pouch for storing precious items, such as jewelry and the like, comprising:

a pliable fabric member having a finish which is soft to the touch;

said fabric member having a triangular shape;

means defining an intermediate portion of said fabric member and including means for stiffening said intermediate portion relative to the remaining portion of said fabric member, whereby the sides of said intermediate portion defines fold lines along which said fabric member may be folded, thereby defining three triangular flaps, the adjacent ends of two of said fold lines being displaced from one another to provide a gap space;

a first closure member being affixed to said fabric member at the region of said gap space;

the remaining flap having a cooperating closure member affixed thereto, as to be releasably joined with said first closure member when said third flap is in the closed position.

2. The soft pouch of claim 1 wherein said fabric member is a velvet-like fabric.

3. The pouch of claim 1 wherein said fabric member is comprised of first and second fabric sheets each sewn to one another to form said triangular shaped pouch;

the seams joining said first and second sheets being hidden seams and arranged along the three sides of said triangular shaped pouch.

4. The pouch of claim 3 wherein a triangular shaped stiffening sheet is positioned between said first and second fabric sheets; and stitch means for joining said triangular shaped stiffening sheet to said first and second fabric sheets, said stitches defining the aforementioned fold lines.

5. The pouch of claim 1 wherein one of said closure means comprises a small patch of loop-type material and wherein the remaining one of said closure means comprises a similar size patch of hook-type material, wherein said closure members provide a releasable closure when said hook-type material and said loop-type material are pressed into one another.

6. The pouch of claim 5 wherein said hook-type patch and said loop-type patch are secured to said pouch by stitching.

7. The pouch of claim 1 wherein said fabric member has a perimeter which, when fully open, defines an isosceles triangle.

8. The pouch of claim 7 wherein the two equal sides of said isosceles triangle are greater in length than the remaining side of said isosceles triangle.

9. The pouch of claim 1 wherein a ribbon is affixed to said intermediate portion.

* * * * *